US011361932B2

(12) United States Patent
Bermuth

(10) Patent No.: US 11,361,932 B2
(45) Date of Patent: Jun. 14, 2022

(54) ANODE HEAD FOR X-RAY BEAM GENERATORS

(71) Applicant: SMITHS DETECTION GERMANY GMBH, Wiesbaden (DE)

(72) Inventor: Jörg Bermuth, Rockenberg (DE)

(73) Assignee: SMITHS DETECTION GERMANY GMBH, Wiesbaden (DE)

( * ) Notice: Subject to any disclaimer, the term of this patent is extended or adjusted under 35 U.S.C. 154(b) by 72 days.

(21) Appl. No.: 16/766,002

(22) PCT Filed: Nov. 21, 2018

(86) PCT No.: PCT/EP2018/082054
§ 371 (c)(1),
(2) Date: Jul. 29, 2020

(87) PCT Pub. No.: WO2019/101784
PCT Pub. Date: May 31, 2019

(65) Prior Publication Data

US 2020/0365362 A1 Nov. 19, 2020

(30) Foreign Application Priority Data

Nov. 21, 2017 (DE) ..... 10 2017 127 372.7

(51) Int. Cl.
*H01J 35/16* (2006.01)
*H01J 35/08* (2006.01)

(52) U.S. Cl.
CPC ..... *H01J 35/16* (2013.01); *H01J 35/08* (2013.01); *H01J 2235/168* (2013.01)

(58) Field of Classification Search
CPC ..... H01J 35/16; H01J 35/08; H01J 2235/168
See application file for complete search history.

(56) References Cited

U.S. PATENT DOCUMENTS 2,948,822 A 8/1960 Paroselli
4,075,526 A * 2/1978 Grubis ..... H01J 35/147 378/124
4,870,671 A 9/1989 Hershyn
6,188,747 B1 2/2001 Geus et al.
7,466,799 B2 12/2008 Miller
(Continued)

FOREIGN PATENT DOCUMENTS

DE 707943 C 7/1941
DE 707943 C1 7/1941
(Continued)

OTHER PUBLICATIONS

International Search Report and Written Opinion in PCT/EP2018/082054 dated Apr. 2, 2019, 8 pages.
(Continued)

*Primary Examiner* — Chih-Cheng Kao
(74) *Attorney, Agent, or Firm* — Armstrong Teasdale LLP

(57) ABSTRACT

An anode head for an anode of an X-ray generating device is provided. The anode head is made of an X-ray attenuating material and has a first opening with a first diameter for a primary electron beam, wherein a circular aperture of a secondary electron absorbing material and having a second opening which is arranged concentrically to the first aperture and has a second diameter which is smaller than the first diameter.

15 Claims, 7 Drawing Sheets

(56) References Cited

U.S. PATENT DOCUMENTS

| | | | | |
|---|---|---|---|---|
| 8,073,108 | B2 | 12/2011 | Kilian | |
| 2010/0278309 | A1 | 11/2010 | Hauttmann | |
| 2011/0188637 | A1* | 8/2011 | Lemaitre | H01J 1/26 378/136 |
| 2012/0257721 | A1 | 10/2012 | Park | |
| 2014/0369469 | A1 | 12/2014 | Ogura et al. | |
| 2017/0287673 | A1* | 10/2017 | Peterson | H01J 35/186 |

FOREIGN PATENT DOCUMENTS

| | | | | |
|---|---|---|---|---|
| DE | 1779915 | U | 12/1958 | |
| DE | 1860224 | U | 10/1962 | |
| DE | 2047751 | A1 | 3/1972 | |
| DE | 2109159 | A1 | 1/1973 | |
| DE | 2653547 | A1 | 6/1977 | |
| DE | 2047751 | B2 | 6/1978 | |
| DE | 3139899 | A1 | 4/1983 | |
| DE | 3635395 | A1 | 4/1987 | |
| DE | 19513291 | A1 * | 10/1996 | H01J 35/147 |
| DE | 19802668 | A1 | 7/1999 | |
| DE | 102006062454 | A1 | 7/2009 | |
| GB | 762375 | A | 11/1956 | |
| GB | 2287164 | B | 9/1995 | |

OTHER PUBLICATIONS

International Preliminary Report for PCT/EP2018/082054, dated Jun. 4, 2020, 12 pages.

* cited by examiner

ANODE HEAD FOR X-RAY BEAM GENERATORS

CROSS-REFERENCE TO RELATED APPLICATIONS

This patent application is a National Stage Entry of PCT/EP2018/082054 filed on Nov. 21, 2018, which claims priority to DE Application No. 10 2017 127 372.7 filed on Nov. 21, 2017, the disclosures of which are hereby incorporated by reference herein in their entirety as part of the present application.

BACKGROUND

The present disclosure relates generally to protection against ionizing radiation, such as X-ray radiation produced by X-ray tubes. In particular, the disclosure concerns a radiation protection device in the form of an improved anode head for the anode of an X-ray generating device, for example an X-ray tube.

The following introductory description serves only for a better understanding of the disclosure and should not be understood as prior art unless it is expressly designated as such.

X-ray tubes as well as their use in an X-ray examination apparatus or X-ray testing apparatus are known, for example, from EP 2 393 103 B1.

FIG. 1 shows a simplified section through a known X-ray tube. X-ray tube 1 has a ceramic housing 2 consisting of a tube body 3 with an annular cross-section, a cover 4 and a base 5. In the tube body 3 there is an exit area 6 for the generated X-rays RS. In the example shown, the exit area is in the form of a thinned housing wall; in a housing in the form of a glass tube, the exit area is usually formed by a glass cylinder of equal thickness. In housing 2, the known assemblies for generating X-ray radiation are arranged. These are essentially a cathode 7 and an anode 8 as well as electrical supply lines 9 for the cathode 7 and an electrically conductive feed-through 10 for the anode 8, which are fixed in a gas-tight manner in the base 5 or in the cover 4. The anode 8 has an anode body 11 which surrounds a target 12 made of a material with a high density and high melting point, for example tungsten. The anode body 11 surrounds the target 12 in order to dissipate heat to a cooler as quickly as possible. Since tungsten is a poor heat conductor, copper is usually used for the anode body 11. The target 12 serves as a target for a primary electron beam PES emanating from cathode 7, which hits the target 12 at the so-called focal point.

The anode body 11 is further equipped with an anode head 13, which contains a first opening 14 for the primary electron beam PES and an exit opening 15 for X-rays RS generated at the target 12. The anode head 13 is primarily used for field formation and for adjusting the size of the focal spot on the target 12. For this reason, the anode head 13 is usually made of copper, which has good electrical conductivity. The outlet opening 15 is designed so that the desired useful radiation is not shielded. Furthermore, the anode head 13 intercepts secondary electrons generated on the target.

As shown in FIG. 2, which is essentially a section of FIG. 1, secondary electrons are released from the target 12 and the anode head 13 by the bombardment with the primary electrons and also by the generated X-ray radiation. FIG. 2 shows simulated trajectories of secondary electrons. The secondary electrons can leave the anode head 13 through the first opening 14, are deflected back towards anode 8 by the existing electric field between cathode 7 and anode 8 outside the anode head 13 and generate X-ray radiation and/or secondary electrons again when they hit the anode head 13. This X-ray radiation and the secondary electrons are non-directional and can stress adjacent components and lead to undesired static charging of adjacent non-conductive or poorly conductive materials, such as glass, ceramics, etc. It is suspected that the additional X-ray radiation generated outside the anode head can lead to a shortened life of the components that are therewith more heavily loaded. In any case, this X-ray radiation requires increased effort in shielding the entire X-ray tube, for example with lead.

The following documents also concern X-ray tubes: DE 20 47 751 A, DE 17 79 915 U, GB 762 375 A, DE 707 943 A, DE 18 60 224 U and U.S. Pat. No. 7,466,799 B2.

BRIEF DESCRIPTION

The present disclosure facilitates improving the known X-ray generating device so that some or all of the problems described in connection with secondary electrons can be eliminated or at least reduced.

Features and details which are related to the inventive anode head, an inventive X-ray generating device and an X-ray inspection apparatus equipped with it are of course also valid in connection with the inventive conversion method, and vice versa. Therefore, mutual reference is made with regard to the disclosure of the individual aspects.

The disclosure facilitates improving the per se known anode head for an anode of an X-ray generating device by inserting a circular aperture, for example made of a material with high resistivity (e.g. an insulator, such as a ceramic), into the first opening in the anode head for the primary electron beam. The circular aperture reduces the cross-section of the opening in the anode head without affecting the geometry of the electrically conductive part of the anode head which is necessary to form the electric field in the area of the target. A large part of the secondary electrons produced are captured by the circular aperture. The diameter of the hole in the circular aperture is dimensioned so that the primary electron beam or the focal spot on the target at the anode body is not affected. The circular aperture may be additionally coated with a conductive layer and/or doped with one or more materials that allow to set a sufficient/suitable (surface) conductivity so that no charge nests can form on the circular aperture.

The solution of the problem required numerous technical considerations. The problem, which had been solved according to the disclosure, could not be solved simply by reducing (the diameter of) the first opening 14 in the known anode head 13 of FIG. 1, as this would have changed the shape of the electric field in the area of target 12 and ultimately the size of the focal spot on target 12. Similarly, it was not possible to simply manufacture the entire anode head 13 from a material with a high resistivity, as the field formation would then also be altered due to the lack of conductivity of the anode head. Such an anode head 13 made of a material with poor conductivity would be charged up to a certain amount of charge by the bombardment with secondary electrons, discharged by flashover to anode 8, and then recharged, etc. This oscillating process would cause an unwanted oscillation of the size of the focal spot on target 12.

The disclosure is characterized by an easy and inexpensive implementation, offers the possibility to reduce the required shielding of the entire X-ray generating device accordingly, allows a longer lifetime of the whole device due to less exposure to X-ray radiation generated outside the anode head, to name but a few advantages.

A first aspect of the disclosure concerns an anode head for an anode with a target of an X-ray generating device. The anode head is made of an electrically conductive material and has a first opening with a first diameter for the passage of a primary electron beam directed towards the target.

In accordance with the disclosure, a circular aperture made of a material which absorbs secondary electrons is joined to or into the anode head. I.e., the material for the circular aperture is selected and/or the circular aperture is dimensioned so that the circular aperture can intercept and capture secondary electrons generated in the area of the target.

According to the disclosure, the circular aperture has a second opening which is concentric to the first opening and has a second diameter which is smaller than the first diameter. The circular aperture is preferably arranged in the anode head in such a way that the primary electron beam directed at the target passes through the first and second openings in the direction of the target (preferably orthogonally and centrally). No absolute or relative values or ranges of values can be given for the diameter of the first opening, since the diameter of the first opening depends essentially on the specific design of an anode head. Also, the diameter itself for a concrete anode head is only scalable within certain limits; in principle, the relationship can be calculated, but in practice the values are usually determined empirically by means of simulations.

Furthermore, the anode head according to the disclosure serves to shape the electric field in the area of the anode head in order to set a desired focal spot (preferably a focal spot size on the target) and, in addition, to intercept and conduct away the secondary electrons generated in the area of the target.

The first and second openings may be circular. For example, the first opening can be a through hole in the front of the anode head facing away from the target. Depending on the material selection for the circular aperture, the second opening can be integrated into the circular aperture during production or also be designed as a through hole.

The first opening of the anode head is located in the intended combination with an anode above the focal spot located on the anode body. Usually, a target material is incorporated into the anode body in the area where the focal spot is located on the anode body, which can, for example, consist of copper as explained at the beginning. In operation, the primary electron beam, which is generated in a known manner by a heated cathode and a high voltage applied between the cathode and the anode, passes through the first opening and creates the focal spot inside the anode head on the target in the anode body. At the focal spot, X-rays whose spectrum consists essentially of the bremsstrahlung (slowing down radiation) of the primary electrons and the characteristic radiation of the target material and/or anode material are generated by the primary electrons.

Tungsten or a tungsten alloy may be used as the target material. In principle, one or an alloy of one or more of the following materials can also be used for the target: copper, molybdenum, rhodium, palladium, silver, cadmium, hafnium, tantalum, tungsten, rhenium, osmium, iridium, platinum, gold, mercury, thallium, lead or bismuth.

The anode head may also have an exit aperture for a part of the X-ray radiation generated. The target in the anode head is usually positioned opposite the primary electron beam in such a way that generated X-ray radiation is emitted from the surface of the target in a particular area. The exit aperture in the anode head may be arranged in the particular area in such a way that X-rays can exit unaffected from the exit aperture in a particular direction which, in the installed position, is aligned with an exit area of the housing of an X-ray generating device. The anode head can thus simultaneously serve as a collimator. This means that the exit aperture already forms the radiation fan for the useful radiation.

Since secondary electrons are also generated in the area of the exit aperture in higher-power X-ray tubes, they can also be shielded there if necessary without hardening the X-ray radiation in particular by placing small plates of beryllium or foils of titanium or copper in the exit aperture, depending on the application. This prevents the charge density from becoming too high, e.g. in the case of a glass housing on the glass in the exit area, which would lead to breakdowns through the glass and thus to the destruction of the X-ray tube.

The anode head can basically be made of copper, which is a material with good thermal and electrical conductivity.

The anode head may be configured to shield X-ray radiation not directed at the exit opening in the anode head as close as possible to the point of origin (the target), in order to save weight in the external shielding of the entire arrangement. For this purpose, the anode head may consist of an element with a high atomic number, such as a heavy metal or an alloy with high density. For example, the anode head may be made of tungsten, tantalum, or an alloy of one or both materials. In one design, a tungsten-copper alloy is used.

The circular aperture may be made of a material with a high resistivity. The circular aperture can be made of a ceramic material. For example, the circular aperture can be made of an oxide ceramic, such as an aluminum oxide ceramic. For example, aluminum oxide, aluminum nitride, zirconium oxide, silicon carbide are suitable, to name a few examples without claiming to be exhaustive. In principle other materials are also suitable. The only prerequisite is that a sufficiently low conductivity can be set; for this purpose, a material that is basically non-conductive should be coatable and/or dopable.

The circular aperture can be made completely, i.e. in its entirety, or at least in a section of a disc in the form of a circular aperture disc and inserted in a corresponding recess in the anode head (in some embodiments without a gap because of the orthogonal alignment of the various openings to the primary electron beam). The corresponding recess for the circular aperture on the anode head can be located on the side of the anode head facing the anode in the installation position or on the side of the anode head facing away from the anode in the installation position of the anode.

The circular aperture can be made completely, i.e. in its entirety, or at least in a section of a cylinder in the form of a hollow cylinder. The hollow cylinder may have an outer diameter which is dimensioned according to the first diameter so that the hollow cylinder in the installation position is inserted into the first opening of the anode head (in some embodiments without a gap because of the orthogonal alignment of the various openings to the primary electron beam).

The circular aperture can be made completely or at least in one cap section in the form of a cap for the anode head, which is attached to the side of the anode head facing away from the anode in the installation position.

The above-mentioned implementation options for the circular aperture can be combined in any way. The circular aperture can be composed of different sections or be monolithic. The only thing to be considered is that in a monolithic design with at least two different sections, the circular aperture must be insertable in a correspondingly complementary first opening in the anode head. It is essentially important that the first and the second opening(s) are arranged concentrically to each other and orthogonal to the primary electron beam.

The electrical conductivity, in particular the surface conductivity, of the circular aperture may be adjusted by coating it with an electrically conductive material and/or by doping the base material of the circular aperture in such a way that the circular aperture is not electrically charged during operation by trapped secondary electrons. This is advantageous to avoid the formation of charge nests on the circular aperture. For example (without excluding the use of other ceramics) to illustrate the principle, the electrical conductivity of silicon carbide can vary over a wide range due to the type of doping material (for example boron and/or aluminum) and the amount of doping.

The material thickness of the circular aperture, which is determined in the direction of the primary electron beam in the intended installation position, and/or the second diameter of the second opening are preferably designed in such a way that a predetermined proportion of the secondary electrons produced during operation on the anode head and/or target are captured by the circular aperture. In principle, the material thickness of the aperture should be such that the secondary electrons are stopped. This depends mainly on the energy of the secondary electrons and the material of the circular aperture.

The circular aperture may be electrically connected to the anode head. The circular aperture can be connected to the anode head e.g. by an active soldering process. Alternatively, or additionally, other conductive connections, such as wedging, are also possible in principle.

The second diameter of the second opening may be adjusted so that the size of the focal spot of the primary electron beam on the target is unchanged compared to an otherwise identical anode head which, however, does not have the circular aperture according to the disclosure.

The anode can be a fixed anode (standing anode) or a rotating anode. This means that, even if the disclosure is explained here using the example of a standing anode, the principles of the disclosure can be easily transferred to an arrangement with a rotating anode.

A second aspect of the disclosure relates to an X-ray generating device, in particular an X-ray tube, with an arrangement including a cathode and an anode, which has an anode head according to one of the implementations explained above in accordance with the first aspect of the disclosure.

A third aspect of the disclosure relates to an X-ray inspection apparatus including an X-ray generating device according to the second aspect of the invention.

A fourth aspect of the disclosure relates to a method of converting an X-ray inspection apparatus including a first X-ray generating device with an assembly of a cathode and an anode having an anode head without a circular aperture according to the disclosure for shielding secondary electrons, the method including the steps of (S1) removing the first X-ray generating device; and (S2) Installation of an X-ray generating device according to the second aspect of the including.

Further advantages, features, and details of the disclosure result from the following description, in which, with reference to drawings, examples of how the invention is implemented are described in detail. The features mentioned in the claims and in the description may be individually or in any combination substantially inventive. Likewise, the features mentioned above and the features further elaborated here may be used individually or in groups in any combination. Functionally similar or identical parts or components are partly provided with the same reference signs. The terms "left", "right", "top" and "bottom" used in the description of the design examples refer to the drawings in an orientation with normally readable figure designation or normally readable reference signs. The shown and described embodiments are not to be understood as exhaustive, but are of exemplary character to explain the invention. The detailed description serves to inform the skilled person, therefore, known structures and processes are not shown or explained in detail in the description in order not to make the understanding of the present description difficult.

DETAILED DESCRIPTION

Figure 1:
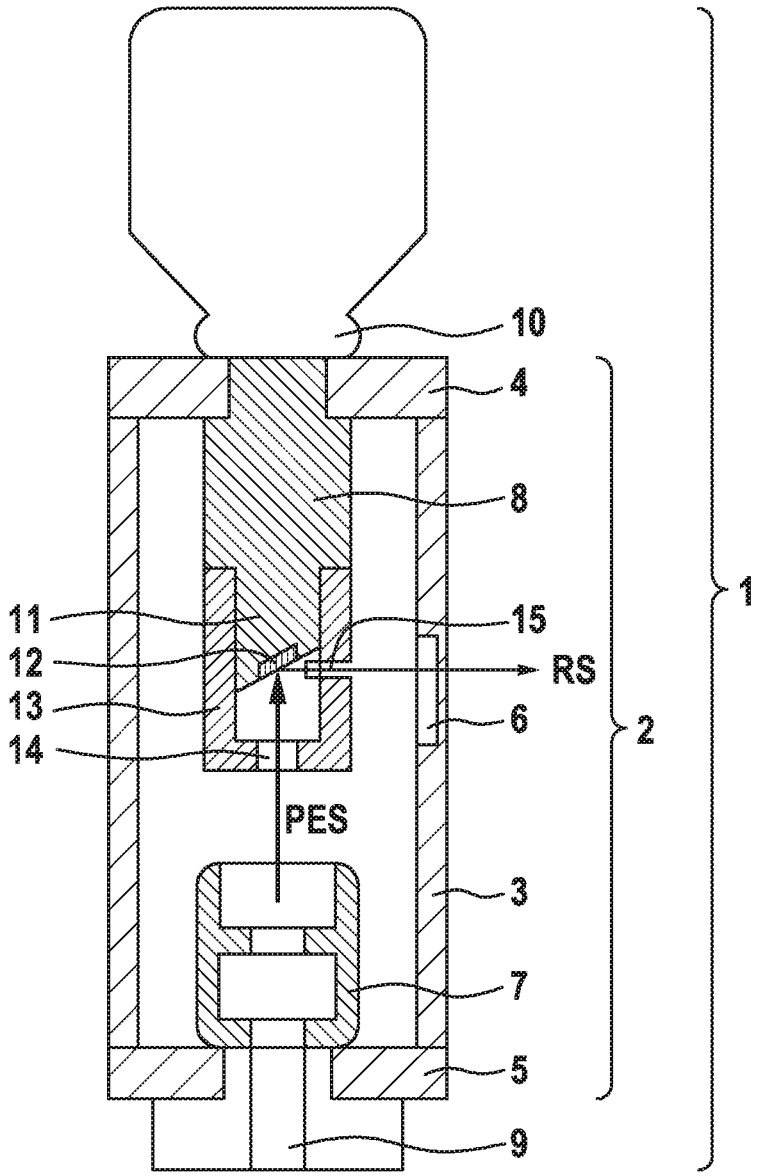
Fig. 1 (Prior Art)
FIG. 1 shows a conventional X-ray generating device with a known anode head.
Figure 3:
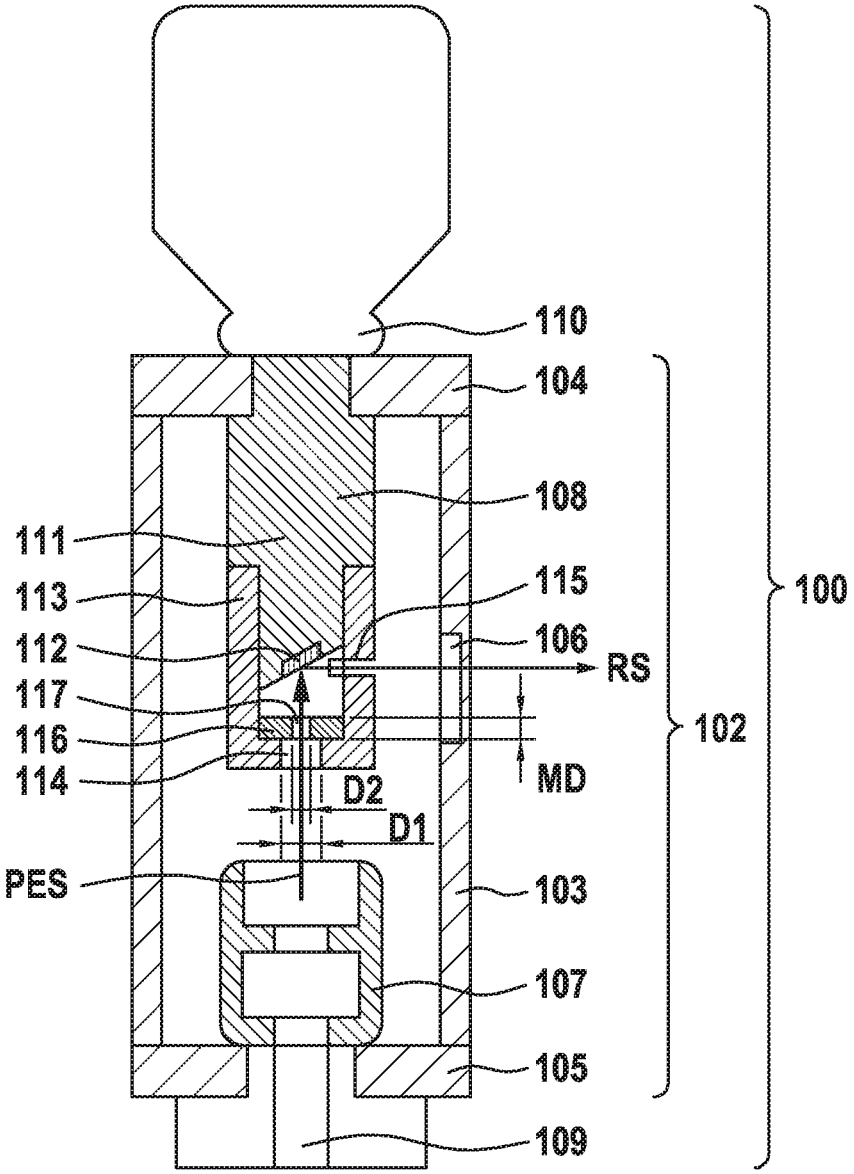
FIG. 3 shows an X-ray generating device with an example of an anode head of the disclosure.

Compared to FIG. 1, FIG. 3 shows a design example of an anode head 113, improved according to the disclosure, for an anode 108 of an X-ray generating device 100. The anode head 113 initially includes an electrically conductive material, for example copper, and has a first opening 114 with a first diameter D1 for a primary electron beam PES.

In addition to the anode head 13 in FIG. 1, the anode head 113 is equipped with a circular aperture 116, which has a second opening 117 concentric with the first opening 114 in the anode head 113 and a second diameter D2. The second diameter D2 is smaller than the first diameter D1. The circular aperture 116 reduces the cross section of the first opening 114 and thus prevents a large proportion of the secondary electrons produced on the anode body 111 and/or target 112 during operation from leaving the anode head 113 through the first opening 114. This leads to a corresponding reduction of the undirected X-ray radiation occurring at the anode head 13 of FIG. 1.

As in FIG. 1, the first opening 114, in intended combination with the anode body 111, is located above the focal spot located on the target 112 encased by the anode body 111, so that the primary electron beam PES, which is generated in a known manner by the heated cathode 107 and the high voltage applied between the cathode 107 and the anode 108, can pass through the first opening 114 and hit the target 112 to generate the desired X-ray radiation RS.

As in FIG. 1, the anode head 113 contains an exit opening 115 for the generated X-ray radiation RS. The anode head 113 fulfils a collimator function with the exit opening 115 by only leaving the anode head 113 unaffected by X-rays directed to the exit area 106 in the housing 102 of the X-ray generating device 100.

For an optimum shielding effect, the anode head 113 is made of an element with a high atomic number, such as a heavy metal or heavy metal alloy, for example tungsten, tantalum, or an alloy of one or both of these materials.

In order not to influence the primary electron beam PES, the circular aperture 116 is made of a material with a high resistivity. In the design example, circular aperture 116 is made of an oxide ceramic, namely an alumina ceramic.

In FIG. 3, the circular aperture 116 is monolithically designed in the form of a circular aperture disc (pinhole disc) and inserted in a corresponding recess in the anode head 113, which is located in the installation position on the side of the anode head 113 facing the anode 108. In other words, the circular aperture 113 is located on the inside of the first opening 114 of the anode head 113. The circular aperture 116 need not be monolithic, but can also be composed of several sections.

The surface conductivity of the circular aperture 116 in the design example is adjusted by doping the base material, i.e. the aluminum oxide ceramic, of the circular aperture 116 in such a way that the circular aperture 116 cannot become electrically charged during operation by trapped secondary electrons. This prevents the formation of charge nests on the circular aperture 116 and a corresponding undesirable effect on the primary electron beam PES.

Alternatively or additionally, the desired surface conductivity of the circular aperture 116 can also be adjusted by coating it with an electrically conductive material.

The material thickness MD of the circular aperture 116, which is measured in the direction of the primary electron beam PES, and the second diameter D2 of the second opening 117 are designed in such a way that, compared to the anode head 13 without circular aperture 116 (FIG. 1), a predetermined proportion of the secondary electrons produced during operation on the anode body 111 and/or target 112 are trapped by the circular aperture 116 or prevented from leaving the anode head 113.

The second diameter D2 of the second opening 116 of the circular aperture 116 is further adjusted so that the size of the focal spot of the primary electron beam PES on the target 112 is unchanged compared to the anode head 13 without circular aperture 116 (FIG. 1).

The circular aperture 116 is permanently connected to the anode head 113 by soldering. An active soldering process was used as the soldering method. Alternatively or additionally, the circular aperture 116 can also be attached mechanically and electrically conductively by wedging it to the anode head 113.

In the embodiment in FIG. 3, anode 108 is a fixed anode (standing anode). Basically, the principles of the disclosure proposed here can be easily transferred to an arrangement with a rotating anode.

Figure 2:
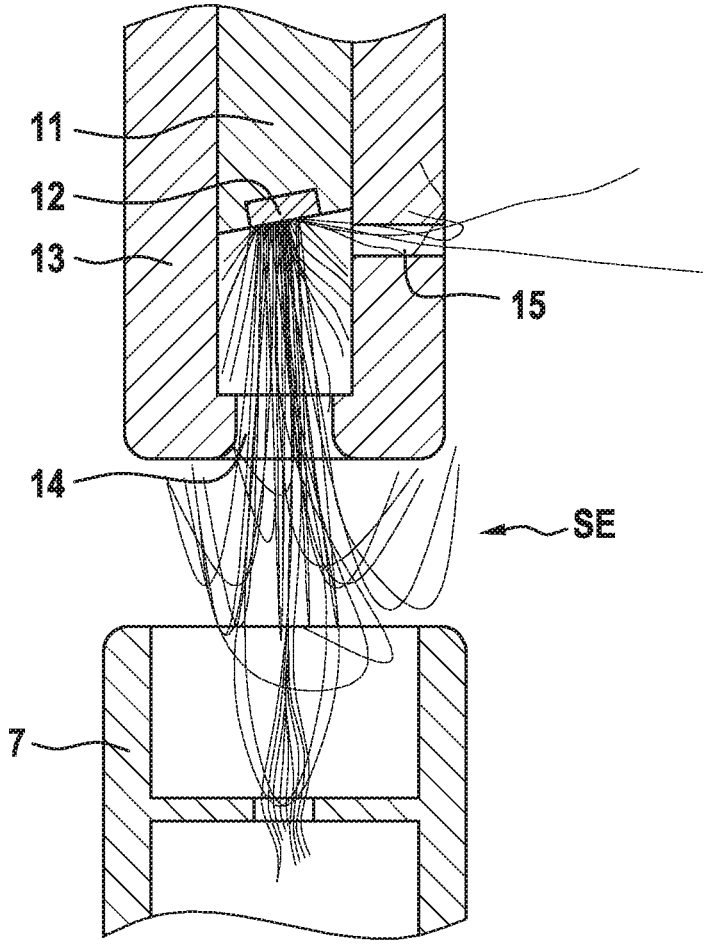
Fig. 2 (Prior Art)
FIG. 2 shows trajectories of simulated secondary electrons at the anode head without the aperture of the disclosure in FIG. 1.
Figure 4:
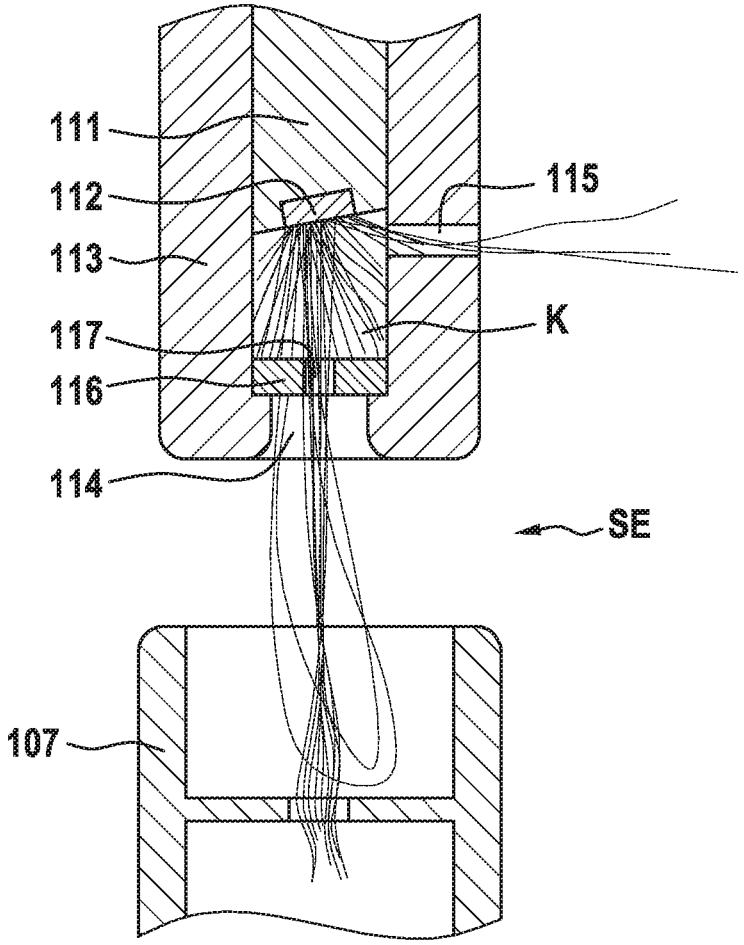
FIG. 4 shows trajectories of simulated secondary electrons on the anode head of the disclosure in FIG. 3.

FIG. 4 shows the trajectories of simulated secondary electrons at the anode head 113 of the X-ray generating device 100 shown in FIG. 3, which is in accordance with the disclosure. In FIG. 4 it can be clearly seen that of the secondary electrons present in the chamber K formed by the anode head 113, circular aperture 116 and anode body 111, only a few can leave the anode head 113 through the first opening 114 of the anode head 113 in comparison with the situation in FIG. 2, since they are intercepted and captured by the circular aperture 116 with the smaller second opening 117. Since the circular aperture 116 has a predetermined surface conductivity, the captured secondary electrons can flow off via the electrically conductive anode head 113 to the anode 108.

Figure 5A:
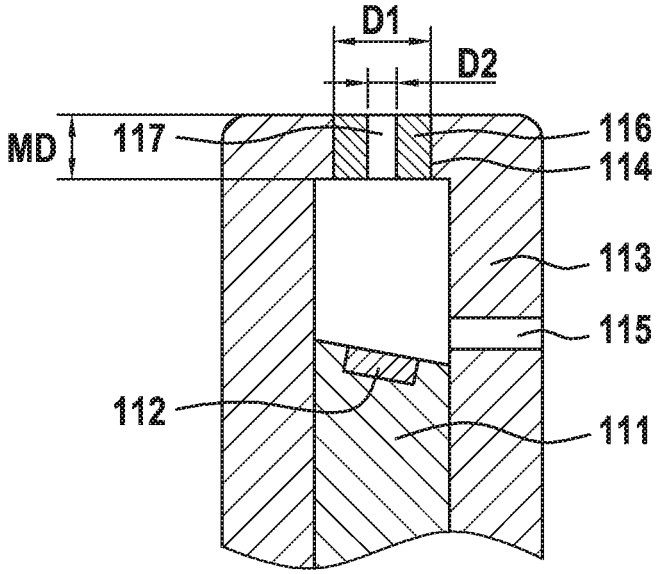
FIGS. 5A-5C non-exhaustively show different design examples for the anode head according to the disclosure.
Figure 5B:
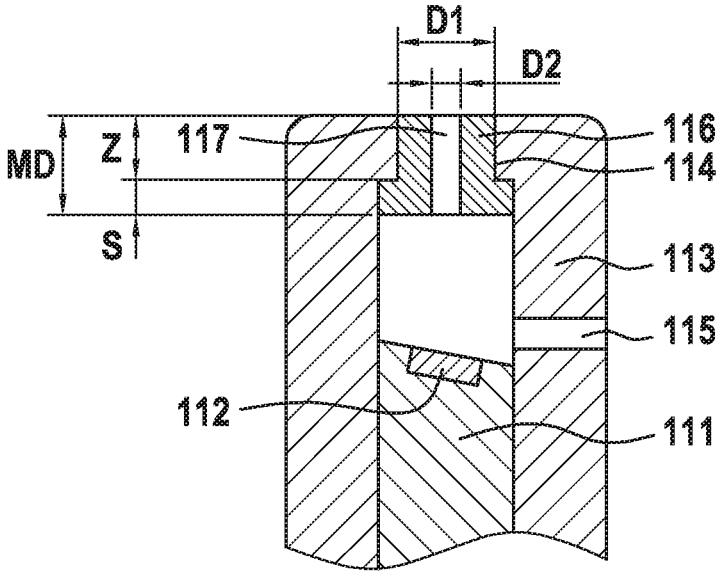
Figure 5C:
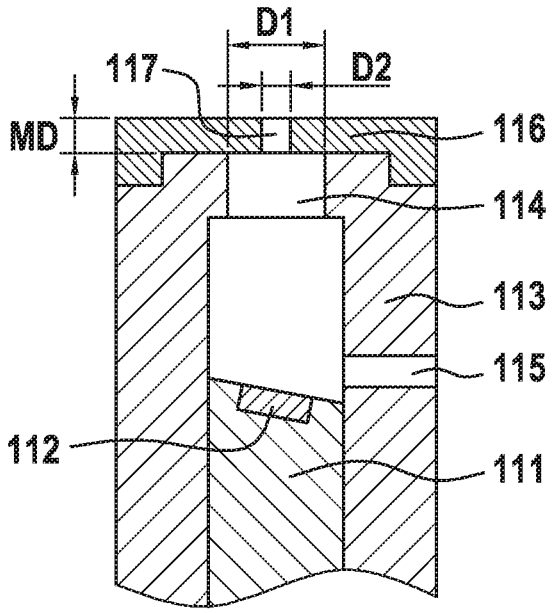

FIGS. 5A-5C non-exhaustively show further possible embodiments for an anode head according to the disclosure.

In FIG. 5A, in comparison to the implementation in FIG. 3, the circular aperture 116 is designed in the form of a hollow cylinder with an outer diameter corresponding to the first diameter D1 of the first opening 114 and is inserted into the first opening 114 of the anode head 113 with a precise fit and connected to the anode head 113 mechanically (e.g. by wedging) and/or by active soldering. The effective material thickness MD of the circular aperture 116 for intercepting secondary electrons thus corresponds to the material thickness of the end face of the anode head 113.

In FIG. 5B, circular aperture 116 is a combination of the implementations in FIGS. 3 and 5A, i.e. circular aperture 116 has a disc section S, which has the shape of a circular aperture disc (cf. FIG. 3), and a cylinder section Z, which has the shape of a hollow cylinder (cf. FIG. 5A). In the overall cross-section, the circular aperture 116 thus has the shape of a large letter "T", the "T" in FIG. 5B being upside down. In FIG. 5B the circular aperture 116 is inserted from the inside into the corresponding recess on the anode head 113. The cylinder section Z is fitted into the already existing first opening 114 of the anode head 113 and the disc section S is inserted into the already existing recess for the anode body 111 from the inside of the anode head 113 and connected to the anode head 113 mechanically (e.g. by wedging) and/or by active soldering. The effective material thickness MD of the circular aperture 116 for intercepting secondary electrons thus corresponds to the material thickness of the front surface of the anode head 113 and additionally to the material thickness of the disc section S of the circular aperture 116.

In FIG. 5C the circular aperture 116 is designed in the form of a cap which is attached to the side of the anode head 113 facing away from the anode 108 in the installation position, i.e. outside the front face of the anode head 113, and is connected to the anode head 113 mechanically (e.g. by wedging) and/or by active soldering. The effective material thickness MD of the circular aperture 116 for intercepting secondary electrons corresponds to the material thickness of the front side of the circular aperture 116.

Figure 6:
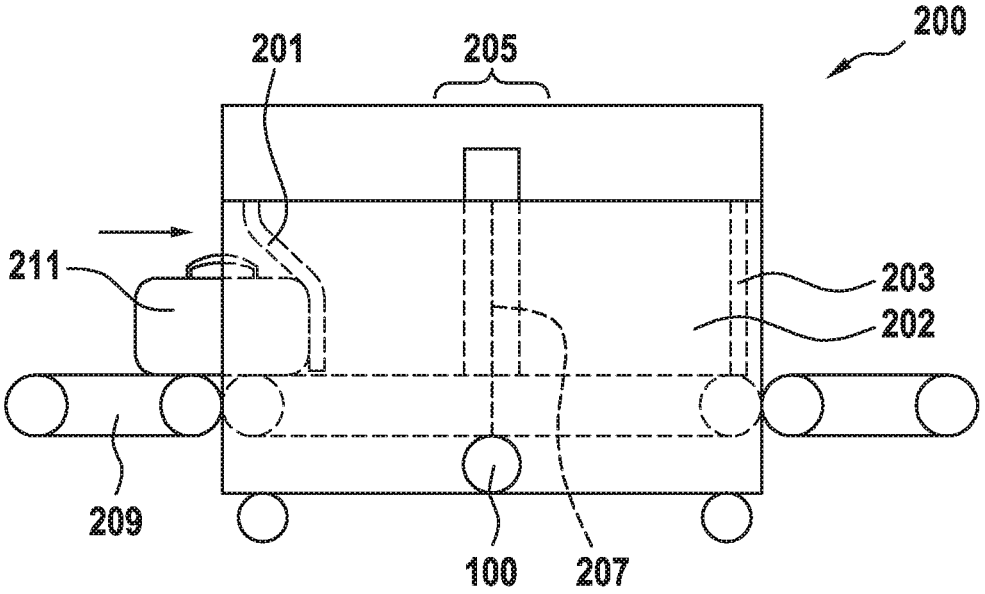
FIG. 6 shows a schematic cross-section of a side view of an exemplary X-ray inspection apparatus with an X-ray generating device, as shown in FIG. 3, for example.

FIG. 6 shows a schematic cross-section of a side view of an exemplary X-ray inspection apparatus 200 with an X-ray generating device 100, as shown for example in FIG. 3. X-ray inspection apparatus 200 has two radiation protection curtains 201, 203, which are each located at an entrance and an exit of a radiation tunnel 202 of the X-ray inspection apparatus 200. Between the two radiation protection curtains 201, 203 there is a radiation area 205 inside the radiation tunnel 202. In the radiation area 205 at least one X-ray generating device 100 and at least one detector array 207 aligned with it are arranged. A conveyor system 209 is used to transport an inspection object, for example a piece of baggage 211, into and through the radiation tunnel 202. The mode of operation of the X-ray inspection apparatus 200 is known per se and need not be explained here.

Figure 7:
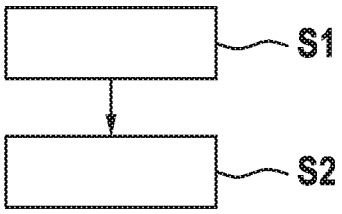
FIG. 7 shows a block diagram of a converting process according to the disclosure.

FIG. 7 shows a block diagram of a converting procedure for an X-ray inspection apparatus which has a first X-ray generating device 1, as shown in FIG. 1, for example, and which has an anode head 13 without the circular aperture 116, as required by the invention, for shielding secondary electrons. The conversion method includes at least the following steps. A first step S1 of dismounting the first X-ray generating device 1. A second step S2 of mounting an X-ray generating device 100 as shown for example in FIG. 3. Thus, existing X-ray inspection apparatus can obtain the advantages of the disclosure described here by a simple exchange.

What is claimed is:

1. An anode head for an anode with: a target of an X-ray generating device, said anode head being made of an electrically conductive material and having a first opening with a first diameter (D1) for a primary electron beam (PES) directed to said target, and a circular aperture with a second opening concentric with said first opening and having a second diameter (D2) smaller than said first diameter (D1), the circular aperture made of an oxide ceramic to avoid influencing a primary electron beam passing through the circular aperture and to facilitate capturing secondary electrons generated by the anode.

2. The anode head according to claim 1, wherein the anode head is made of copper or an electrically conductive element having a high atomic number.

3. The anode head according to claim 2, wherein the anode head consists of tungsten, tantalum, or an alloy of copper with tungsten or tantalum.

4. The anode head according to claim 1, wherein the circular aperture is made completely or at least in one disc section in the form of a pinhole disc and is inserted into the anode head in an associated recess, wherein the recess is located on the side of the anode head facing the anode in an installation position or on the side of the anode head facing away from the anode in the installation position.

5. The anode head according to claim 1, wherein the circular aperture is made completely or in a cylinder section in the form of a hollow cylinder with an outside diameter equal to the first diameter (D1) and is arranged in the first opening of the anode head.

6. The anode head according to claim 1, wherein the circular aperture is made completely or in a cap portion in the form of a cap which is attached to the side of the anode head remote from the anode in an installation position.

7. The anode head according to claim 1, wherein the electrical conductivity of the circular aperture is adjusted by coating with an electrically conductive material and/or by doping the oxide ceramic in such a way that the circular aperture is not electrically charged during operation by trapped secondary electrons.

8. The anode head according to claim 1, wherein the material thickness of the circular aperture in the direction of the primary electron beam (PES) and/or the second diameter (D2) are designed such that a predetermined proportion of the secondary electrons produced on the target or the anode head during operation are captured by the circular aperture.

9. The anode head according to claim 1, wherein the circular aperture is electrically conductively connected to the anode head.

10. The anode head according to claim 1, wherein the second diameter (D2) of the second opening is adjusted such that the size of the focal spot of the primary electron beam (PES) on the target is unchanged compared to an anode head without the circular aperture.

11. The anode head according to claim 1, wherein the anode is a fixed anode or a rotating anode.

12. An X-ray generating device with an arrangement comprising a cathode and an anode, which has an anode head according to claim 1.

13. An X-ray inspection apparatus with an X-ray generating device according to claim 12.

14. A converting method for an X-ray inspection apparatus comprising a first X-ray generating device with an arrangement of a cathode and an anode having an anode head without a circular aperture for shielding secondary electrons, the method comprising the steps of dismounting said first X-ray generating device; and installing an X-ray generating device according to claim 12.

15. The anode head according to claim 1, wherein the anode head defines a chamber having a chamber diameter, wherein the chamber diameter is larger than both the first diameter and the second diameter, wherein the chamber is positioned between the anode and the first opening, wherein the chamber is positioned between the anode and the second opening, and wherein the chamber is concentric with both the first opening and the second opening.

* * * * *